United States Patent [19]

Cash

[11] Patent Number: 4,551,201

[45] Date of Patent: Nov. 5, 1985

[54] PAPER SIZING COMPOSITION AND METHOD

[75] Inventor: Gordon G. Cash, Asheville, N.C.

[73] Assignee: Olin Corporation, Pisgah Forest, N.C.

[21] Appl. No.: 629,516

[22] Filed: Jul. 10, 1984

[51] Int. Cl.[4] ..... D21H 3/16

[52] U.S. Cl. ..... 162/158; 8/116.4; 162/179

[58] Field of Search ..... 162/158, 179; 8/116 R; 560/149, 150; 568/28; 536/59

[56] References Cited

U.S. PATENT DOCUMENTS

| | | | |
|---|---|---|---|
| 3,337,615 | 8/1967 | Roberts et al. | 560/149 |
| 3,337,636 | 8/1967 | Scanley | 568/32 |
| 3,576,712 | 4/1971 | Hine, Jr. et al. | 252/51.5 R |
| 4,043,863 | 8/1977 | Bjorklund et al. | 162/158 |

OTHER PUBLICATIONS

Chemical Abstracts, vol. 68, p. 96720n (1968).
Chemical Abstracts, vol. 72, p. 91609f (1970).
Chemical Abstracts, vol. 99, p. 72395z (1983).

*Primary Examiner*—Peter Chin
*Attorney, Agent, or Firm*—Kerkam, Stowell, Kondracki and Clarke

[57] ABSTRACT

A method of sizing cellulose fibers with a sizing agent having the formula:

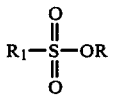

Where:

$R_1$ is an alkyl group having from 1 to 5 carbon atoms, and

R is an alkyl group having 12–24 carbons is disclosed.

21 Claims, No Drawings

PAPER SIZING COMPOSITION AND METHOD

BACKGROUND OF INVENTION

1. Field of Invention

The present invention relates to a method and composition for sizing cellulosic fibers or cellulosic fiber-containing material.

2. Prior Art

Numerous compositions and methods have been suggested heretofore for sizing paper, i.e., rendering the paper more resistant to penetration by liquids. Materials such as resin, various hydrocarbon and natural waxes, starches, glues, casein, asphalt emulsions, synthetic resins and cellulose derivatives have been employed as sizing agents. See, e.g., U.S. Pat. Nos. 3,084,093; 3,084,092; 2,995,483; 2,964,445; 2,941,919; 2,903,391; 2,872,315; 2,830,916; 2,764,483; 2,684,300, etc.

Typically, such derivatives are added directly to the paper making stock as "beater additives" and precipitated on the paper as it is formed to yield "internal" or "engine" sizing. Alternatively, the paper sheet may be passed, after formation, through a size solution, or over a roll wetted with the size solution to produce "tub-sized" or "surface-sized" paper sheets.

Reagents containing functional groups or which are merely precipitated on paper which react with the cellulose content of paper have also been utilized as sizing agents.

For example, U.S. Pat. No. 3,050,437 discloses the use of hydrophobic isocyanates as tub-sizing agents.

U.S. Pat. No. 3,337,636 discloses that various substituted trisulfonylmethanes may be employed to size paper by precipitation thereof on the cellulose fibers of the paper.

Westfelt et al, Cellul. Chem. Technol., Vol. 17(2), pp. 165–77 (1983) discloses the utilization of certain sulfonyl reagents as wet strength additives for paper.

Lukyanwa, Tekst. Prom. (Moscow), Vol. 27(8), pp. 51–2 (1967) [Chemical Abstracts 68, 96720n (1968)] and Rabinovich et al, Khim. Tekhnol. Proizrod. Tsellyul, 1968, pp. 148–56 [Chemical Abstracts, 72, 91609f (1970)] relate to the utilization of cellulose ethanesulfonate as a sizing agent for cellulose fibers. The derivative is, however, precipitated on the fibers.

U.S. Pat. No. 4,043,863 discloses the use of sulfamoylchlorides as cellulose fiber sizing agents.

U.S. Pat. No. 3,576,712 relates to the use of a composition containing a 2-chloroalkyl sulfone, a 2-chloroalkyl sulfoxide or a 2-chloroalkyl sulfide as paper sizing agents.

It is an object of the present invention to provide a novel composition and method for the surface sizing of paper based on the use of certain long chain alkyl sulfonates which react with the cellulose content of the paper.

SUMMARY OF THE INVENTION

The present invention provides a method for sizing cellulose fibers or cellulose fiber-containing material comprising reacting the cellulose fibers with a sizing agent having the formula:

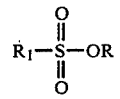

wherein:

$R_1$ is an alkyl group having from 1 to 5 carbon atoms, and

R is an alkyl group having from 12 to 24 carbon atoms.

The present invention also provides a composition for sizing paper comprising an organic solvent solution of an organic sulfonate having the formula:

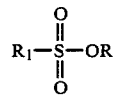

wherein:

$R_1$ is an alkyl group of 1 to 5 carbon atoms, and

R is an alkyl group of 12 to 24 carbon atoms.

There is also provided by the present invention, a cellulosic fiber containing material sized according to the above-described method.

DETAILED DESCRIPTION OF THE INVENTION

The present invention is predicated on the discovery that the reaction of organic sulfonates of the above formula with cellulosic fibers greatly increases the hydrophobicity thereof. Therefore, the method and composition of the invention are useful for the treatment of any cellulosic fiber-containing material where it is desired to render the fibers or material resistant to the penetration of liquids, particularly water. Thus, the invention may be utilized to size paper, treat cotton to decrease dye penetration, or increase the hydrophobic character of any other cellulosic material having reactive OH groups.

The reaction between cellulose fibers and the organic sulfonates occurs readily in the presence of a base. Preferably, the reaction is carried out at a pH from about 11 to about 14. Any base inert with respect to the organic sulfonate and the cellulosic fibers may be employed to render the reaction medium basic. Suitable bases include water soluble and water-compatible alkali salts and substituted or unsubstituted ammonium salts which are sufficiently basic to produce the desired pH that do not interfere with the reaction such as sodium hydroxide, tetrabutylammonium hydroxide, and benzyltrimethylammonium hydroxide.

The organic sulfonates of the above formula do not readily lend themselves to "internal" or "engine" sizing procedures inasmuch as the basic conditions required for reaction between the cellulose fibers and the sulfonate generally far exceed those normally found in the head box or other stage of the paper making process during which additives are added to the slurry.

Therefore, when sizing paper according to the method of the invention, it is preferred to "surface size" the paper. Any conventional surface sizing techniques may be employed to carry out the invention. Thus, the paper sheet may be passed through a tub of a solution of the organic sulfonate or passed over a roller or other applicator in contact with a solution of the sulfonate.

Those skilled in the art, having been exposed to the principles of the invention, will be aware of suitable techniques for achieving the sizing reaction without the exercise of undue experimentation.

When sizing paper it is preferable to react the cellulosic fibers thereof with about a 2% weight/volume solution of the organic sulfonate. Amounts less than 0.5% weight/volume will not enhance the hydrophobicity of the cellulosic fibers to any significant degree. Generally, amounts greater than about 5% weight/volume will not result in any added degree of hydrophobicity.

The preferred method of carrying out the invention is to pre-wet the paper substrate with an aqueous solution of the base and then wet the substrate with a solution of the organic sulfonate for a time sufficient to allow the reaction to go to completion. Preferably, the paper, pre-wetted with basic solution, is allowed to dry before wetting with the organic sulfonate solution. Drying the pre-wetted paper may be accelerated by heating to a temperature in the range of from about 40° C. to about 75° C.

The preferred organic sulfonate is octadecylmethane sulfonate, i.e., the compound of the above formula wherein $R_1$ is methyl and R is octadecyl.

The organic sulfonate is preferably dissolved in an organic solvent for reaction with the cellulosic fibers. Any suitable organic solvents for the organic sulfonate may be employed which is inert with respect to the cellulosic fiber-containing material. Suitable such solvents include lower alkyl sulfoxides, N,N-dimethylformamide, sulfolane, etc.

The preferred solvent is dimethylsulfoxide (DMSO). Generally, the solution should contain from about 1.5% to about 5%, preferably from about 2% to about 3%, by weight/volume, of organic sulfonate, in order to enable the reaction with the cellulose fibers to proceed efficiently.

It is preferred to conduct the reaction at a temperature of from about 100° C. to about 125° C. in order to drive the reaction to completion in an economically efficient manner.

The reaction between the cellulosic fibers and the organic sulfonate sizing agent is generally completed in from about 0.5 to about 2 min. when conducted at the above temperatures.

Preferably, the cellulosic fiber-containing material is washed with a suitable liquid, e.g., water, following completion of the reaction to remove excess base, organic sulfonate, solvent, etc.

Following completion of the reaction between the cellulosic and organic sulfonate, the cellulosic fiber-containing material is dried to produce the sized product. Optimal drying may be accomplished by heating the material at a temperature of from about 40° C. to about 75° C.

The invention is illustrated by the following non-limiting examples.

EXAMPLE 1

One side of a sheet of paper, basis weight 25 g/m$^2$ and Greiner porosity 45 mL/15 sec., containing 25% $CaCO_3$ filler was contacted with a 5% weight/volume aqueous solution of tetrabutylammonium hydroxide until the paper was thoroughly wetted. The paper was dried by heating to 75° C. for 40 seconds. One side of the dried sheet of paper was contacted with a 3% solution of octadecyl methanesulfonate in dimethyl DMSO at 100° C. until the paper was again thoroughly wetted. The wetted paper was dried at 120° C. for 30 seconds at which time the reaction between the sulfonate and cellulose was complete. The paper was washed twice with water and briefly dried at 50° C.

The effectiveness of the sizing reaction was determined with a Hercules Sizing Tester, Model KA. This instrument measures, by reflectance, the speed of penetration of an aqueous ink through the sheet.

The sized paper exhibited an ink penetration time greater than 500 seconds. The untreated paper exhibited an ink penetration time of 0.5 second.

Those skilled in the art, having been exposed to the principles of the invention, will be able to determine optimum reaction parameters, depending upon the particular cellulosic fiber-containing material to be sized and the organic sulfonate selected without the exercise of undue experimentation.

The alkyl sulfonate esters utilized as sizing agents in the method, composition and product of the invention may be prepared according to the method of Crossland et al [J. Org. Chem., Vol. 35, pp. 3195–96 (1970)]; i.e., the addition of an excess of an alkanesulfonyl chloride to a solution of the esterfying long chain alcohol in an appropriate solvent containing triethylamine. Those skilled in the art will recognize that longer chain alcohol reactants will require less polar solvents.

EXAMPLE 2

An emulsion was prepared by blending water 570 mL, 5% cooked starch suspension 400 mL, sodium lignin sulfonate 2.0 g and octadecyl methanesulfonate 30.0 g in a high-speed commercial blender for 10 min.

Samples of paper pretreated with base (sodium hydroxide) and dried as in Example 1 were wetted with the above emulsion and squeezed between rubber rollers. The samples thus treated were dried for 2 minutes at 120° C., washed twice with water and dried briefly at 50° C.

The effectiveness of the sizing reaction was determined as in Example 1.

Under the above conditions, a penetration time of 164 seconds was obtained.

I claim:

1. A method for sizing cellulose fibers or cellulose fiber-containing material comprising reacting said cellulose fibers with an amount of a sizing agent and for a time sufficient to render said cellulose fibers hydrophobic, said sizing agent having the formula:

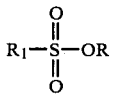

wherein:

$R_1$ is an alkyl group having from 1 to 5 carbon atoms, and

R is an alkyl group having from 12 to 24 carbon atoms.

2. The method of claim 1 wherein said reaction between said cellulose fibers and said sizing agent is carried out at a pH of from about 11 to about 14.

3. The method of claim 1 wherein said cellulose fibers are contained in paper.

4. The method of claim 3 wherein the cellulose fibers of said paper are reacted with a solution or emulsion of said sizing agent containing from about 1.5% to about 5% weight/volume of said sizing agent.

5. The method of claim 4 comprising wetting said paper with an aqueous solution of a base prior to wetting thereof with said solution or emulsion of organic sulfonate.

6. The method of claim 4 wherein said paper wetted with said aqueous solution of base is allowed to dry prior to wetting thereof with said solution or emulsion of organic sulfonate.

7. The method of claim 3 wherein said paper wetted with said aqueous solution of base is dried by heating.

8. The method of claim 7 wherein said drying by heating is carried out at a temperature of from about 40° C. to about 75° C.

9. The method of claim 5 wherein said base is a tetraalkylammonium hydroxide.

10. The method of claim 5 wherein said base is tetrabutylammonium hydroxide.

11. The method of claim 1 wherein $R_1$ is methyl and R is octadecyl.

12. The method of claim 4 wherein said solution of organic sulfonate comprises a solution of the sulfonate in an organic solvent inert with respect to said paper.

13. The method of claim 12 wherein said organic solvent is selected from the group consisting of lower alkyl sulfoxides, N,N-dimethylformamide, and sulfolane.

14. The method of claim 12 wherein said organic solvent is dimethyl sulfoxide.

15. The method of claim 4 wherein said paper is wetted with said solution of organic sulfonate at a temperature from about 95° C. to about 105° C.

16. The method of claim 12 wherein $R_1$ is methyl, R is octadecyl, said solvent is dimethyl sulfoxide and said solution contains from about 1.5% to about 5%, weight/volume of said sulfonate.

17. The method of claim 12 wherein said paper is dried by heating after reaction of said sulfonate with said cellulose.

18. The method of claim 17 wherein said drying by heating is carried out at a temperature of from about 100° C. to about 125° C.

19. The method of claim 4 wherein said organic sulfonate is allowed to react with the cellulose in said paper for a time of from about 0.5 to about 2 min.

20. The method of claim 4 wherein, following said reaction, said paper is washed with water to remove excess base, solvents and organic sulfonate and dried.

21. The sized cellulose fiber or cellulose-containing material produced according to the method of claim 1.

* * * * *